US011226122B1

(12) United States Patent
Cash et al.

(10) Patent No.: US 11,226,122 B1
(45) Date of Patent: Jan. 18, 2022

(54) MODULAR RECYCLING AIR CURTAIN DEVICE TO REPLACE PERSONAL PROTECTION EQUIPMENT (PPE) FOR REDUCTION IN THE SPREAD OF VIRUSES SUCH AS COVID-19

(71) Applicants: James T. Cash, Hackettstown, NJ (US); Olivia Cash, Hackettstown, NJ (US)

(72) Inventors: James T. Cash, Hackettstown, NJ (US); Olivia Cash, Hackettstown, NJ (US)

( * ) Notice: Subject to any disclaimer, the term of this patent is extended or adjusted under 35 U.S.C. 154(b) by 0 days.

(21) Appl. No.: 16/923,681

(22) Filed: Jul. 8, 2020

(51) Int. Cl.
*F24F 3/163* (2021.01)
*F24F 3/14* (2006.01)
*F24F 8/22* (2021.01)

(52) U.S. Cl.
CPC ..... *F24F 3/163* (2021.01); *F24F 3/14* (2013.01); *F24F 8/22* (2021.01)

(58) Field of Classification Search
CPC .... F24F 3/14; F24F 3/1607; F24F 2003/1667; F24F 3/163; F24F 8/22
USPC ..... 454/191
See application file for complete search history.

(56) References Cited

U.S. PATENT DOCUMENTS 2,507,634 A * 5/1950 Hill ..... F24F 13/0604 454/231
3,151,929 A * 10/1964 Potapenko ..... A61G 10/02 422/120
3,511,162 A * 5/1970 Truhan ..... A61G 13/108 454/187
5,306,207 A * 4/1994 Courts ..... F24F 7/06 411/401
5,758,387 A * 6/1998 McNamara ..... A47L 5/38 15/301
6,217,437 B1 * 4/2001 Murray ..... A01K 1/031 119/419
6,926,664 B2 * 8/2005 Koch ..... A61G 11/00 600/22
2004/0221554 A1 * 11/2004 Iijima ..... B01D 50/00 55/385.2
2010/0003912 A1 * 1/2010 Jeng ..... B01D 46/10 454/251
2019/0234645 A1 * 8/2019 Haar ..... A61G 13/108

* cited by examiner

*Primary Examiner* — Allen R Schult
(74) *Attorney, Agent, or Firm* — Thomas J. Germinario

(57) ABSTRACT

A module air curtain and recirculation system that can be incorporated into various tables and workstations that provides 1) an effective air curtain between individuals, 2) a reduction of harmful viruses and 3) the ability for two or more people to be in close proximity without having to wear personal protective equipment such as face masks.

9 Claims, 5 Drawing Sheets

1. Purified Air
2. Clean Air, Air Curtain (+ pressure)
3. Air Intake, Recycled Air (- pressure)

MODULAR RECYCLING AIR CURTAIN DEVICE TO REPLACE PERSONAL PROTECTION EQUIPMENT (PPE) FOR REDUCTION IN THE SPREAD OF VIRUSES SUCH AS COVID-19

CROSS-REFERENCE TO RELATED APPLICATIONS

Not Applicable.

STATEMENT REGARDING FEDERALLY SPONSORED RESEARCH OR DEVELOPMENT

This invention was not made with government support. The government does not have certain rights in the invention.

REFERENCE TO SEQUENCE LISTING, A TABLE, OR A COMPUTER PROGRAM LISTING COMPACT DISC APPENDIX (IF APPLICABLE)

Not Applicable.

BACKGROUND OF THE INVENTION

Field of the Invention apparatus for indoor air filtration and conditioning creating an air curtain between and around people. The device captures aerosolized droplets expelled from occupants and recirculates cleaned air to operate the air curtain while greatly increasing effective air changes per hour in spaces it is employed. While portable room air purifiers are used to improve the air quality of indoor spaces and reduce particles, allergens, and viruses, they do little to stop the person to person transmission of viruses. This invention solves these deficiencies. Through applied effort, ingenuity, innovation and testing these issues have been solved by the embodiment of the presently disclosed modular system. Employment of this invention can allow businesses, schools and restaurants to resume more normal activity.

BRIEF SUMMARY OF THE INVENTION

Presently, air conditioning systems used in homes, office buildings and restaurants can effectively clean and condition air. HVAC systems may be augmented to include viral reducing components such as HEPA filters, electrostatic collectors for fine particulate, and/or UV light to destroy pathogens. These enhancements do little to eliminate virus transmission from person to person. The expelled droplets exhausting out of one person enter the respiratory system of another person who is in close proximity. To reduce transmission the world has adopted the practice of wearing face masks, social distancing and installing physical barriers which has proven to be somewhat effective at reducing viral transmission. Face Masks provide a level of protection by capturing some of the expelled droplets. Unfortunately, this is not practical for activities such as eating and drinking.

It is therefore the purpose of this invention to provide similar or greater protection while eliminating the need for cumbersome PPE. This invention provides further protection through additional air filtration and pathogen removal within the rooms it is employed. In addition to reduction of pathogen transfer between individuals in close proximity these devices increase air purification within the building and allow for an increased percentage of maximum occupancy.

As will be evident in FIGS. 2 and 3, this invention can be applied in a variety of embodiments and is not intended to exclude those that are not shown or to suggest the only ones that are shown. In FIG. 3 for instance, an individual workstation is shown that can be utilized at a cashier station. A similar one placed for the customer side of the counter will protect both individuals and allow removal of transparent dividers and face masks.

Method of reducing transmission of the virus includes three steps. These are: 1) A barrier or system to capture droplets, 2) increasing air exchange in the environment, and 3) removing pathogens through air filtration or other means that reduce concentration including but not limited to destruction through sufficient exposure to UV light. This invention achieves all three of these elements at great efficiency. Optional features include modulating the air humidity or temperature for added comfort. A full scale test apparatus was constructed to evaluate and achieve these desired results. These optional features are shown in FIG. 1.

DETAILED DESCRIPTION OF THE INVENTION

Throughout human history the understanding and prevention of disease has been advancing. Even so, as experienced in 2019-2020 globally, a pandemic can quickly spread and bring society to a halt. The person-to-person transmission of viruses and other pathogens is primarily through the respiratory system. Presently, air conditioning systems used in homes, office buildings and restaurants can effectively clean and condition air. HVAC systems can be augmented to include viral reducing components such as HEPA filters, electrostatics for fine particulate and/or UV light to destroy pathogens. Even so, such systems do little to eliminate direct virus transmission from person to person. Science recognizes that expelled droplets exhausted out of one person can have enough momentum to suspend in the air and travel up to or even beyond 6 feet and enter the respiratory system of another person. To combat this, nearly all the world has adopted the practice of wearing face masks which when all parties in proximity wear them the viral spread is reduced. Unfortunately, this is not practical for interactions such as eating and drinking and substantially interferes with activities such as conducting business and in-person education, to name a few. It is therefore the purpose of this invention to provide similar or better protection while eliminating the need for cumbersome PPE. ASHRAE guidelines and building codes will either restrict the number of occupants or require an increased number of air changes per hour of a given building or room. Unfortunately, these changes cause great economic hardship on businesses such as restaurants and offices requiring extensive modification or enhancement to the ventilation system. Taking measures to condition additional outside air to meet indoor air quality will increase energy usage. This invention helps satisfy these needs by adding additional air filtration and pathogen removal within the rooms it is employed. In the example of a dining table or tables located in a typical room with normal separation, the air purification rate of the machine within said room can achieve up to 20 air changes per hour. Typical air changes in residential or commercial settings typically range from 1 to 4 air changes per hour. Thus, in addition to reduction of pathogen transfer between individuals in close proximity, these devices increase air purification and air changes within the building, reducing the concentration of pathogens and enabling buildings to increase and/or reach maximum capacity of occupants once again.

Figure 1:
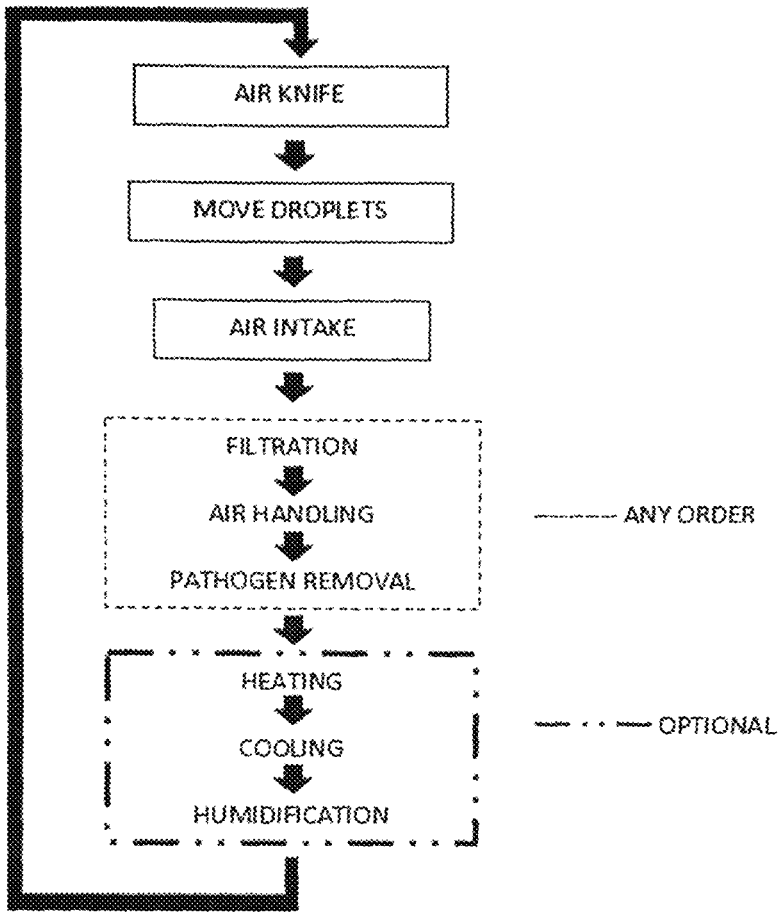
FIG. 1 is a block diagram showing both necessary and optional process steps.
Figure 2:
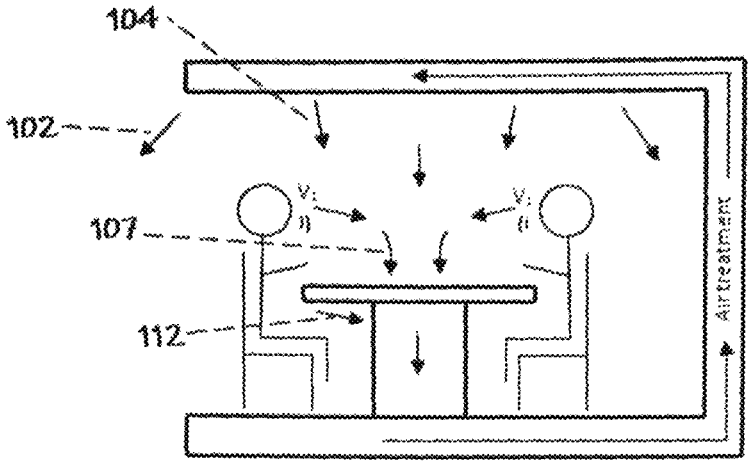
FIG. 2 is a simplified diagram of one embodiment of the invention showing air flow patterns.
Figure 3:
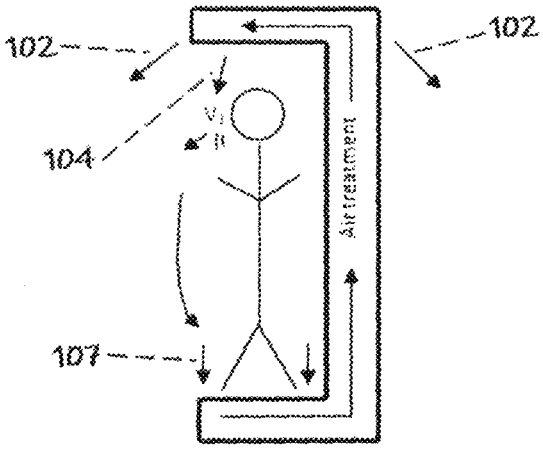
FIG. 3 is a simplified diagram of one embodiment for a work station with occupant standing.

As will be evident in FIGS. 2 to 3, this invention can be configured in various ways and is not intended to suggest only those shown. In FIG. 3 for instance, an individual workstation is shown that can be utilized at a cashier station. A similar device placed on the customer side of the counter will protect both individuals and allow removal of transparent dividers and face masks.

Extensive studies have shown that the transfer mechanism of viruses such as Covid/SARS is primarily through the airborne droplets that are exhausted from one person and then inhaled by another person in close proximity. Recent testing of droplet quantity and size using planes of lasers reveal a significantly higher quantity of droplets than previously known. Most droplets range from 1 to 100 microns in size, however, due to evaporation they quickly reduce in size. As they reduce in size their buoyancy in air increases, allowing the droplets to travel further. For that reason, the closer an air curtain is to the source (mouth) the easier it is to redirect the droplets. Without redirection and capture these droplets can travel across a room. The protection a face mask offers is the capture of some of these droplets that contain the virus, not the virus alone.

"Airborne transmission is different from droplet transmission as it refers to the presence of microbes within droplet nuclei, which are generally considered to be particles <5 microns in diameter, can remain in the air for long periods of time and be transmitted to others over distances greater than 1 m."[1]

The current method of reducing transmission of the virus includes three steps. These are: 1) a method to capture droplets, 2) increasing air exchanges in the environment, and 3) removing pathogens through air filtration or other means that reduce concentration including but not limited to destruction through sufficient exposure to UV light. This invention achieves all three of these elements at great efficiency. The simplest example of the effects and benefits of increased air movement and air exchange is seen with outdoor dining versus indoor dining. Outdoor dining is considered 20 times safer than indoor dining as the natural breeze and nearly endless air changes effectively reduce transmission and concentration of droplets and therefore reduce the infection rate of the virus. Recent regulations easing social distancing restrictions first allow and prefer outdoor dining over indoor dining for this reason. However, further examination would demonstrate that the outdoor conditions also hold similar risks. Depending on the direction of wind, the movement of air can allow the droplets to travel greater distances between people. To visually explain, consider the analogy between the discharge of droplets from talking with that of the discharge from an aerosol can, such as spray paint. It is obvious that spraying paint in the same direction as the wind will carry the paint further, while spraying paint against the wind will slow the velocity and decrease the distance that the paint travels. So when two people are standing at the recommended 6 feet apart to socially distance, the exhaled droplets of one person can still reach the other person depending on the direction of the wind. It is simply the chance that the air is moving in the preferred direction that makes the outdoors a safer social environment. This invention not only provides the necessary air movement, conditioning, and cleansing, but it also controls the direction of the air flow to safely re-direct and capture exhausted droplets.

Figure 4:
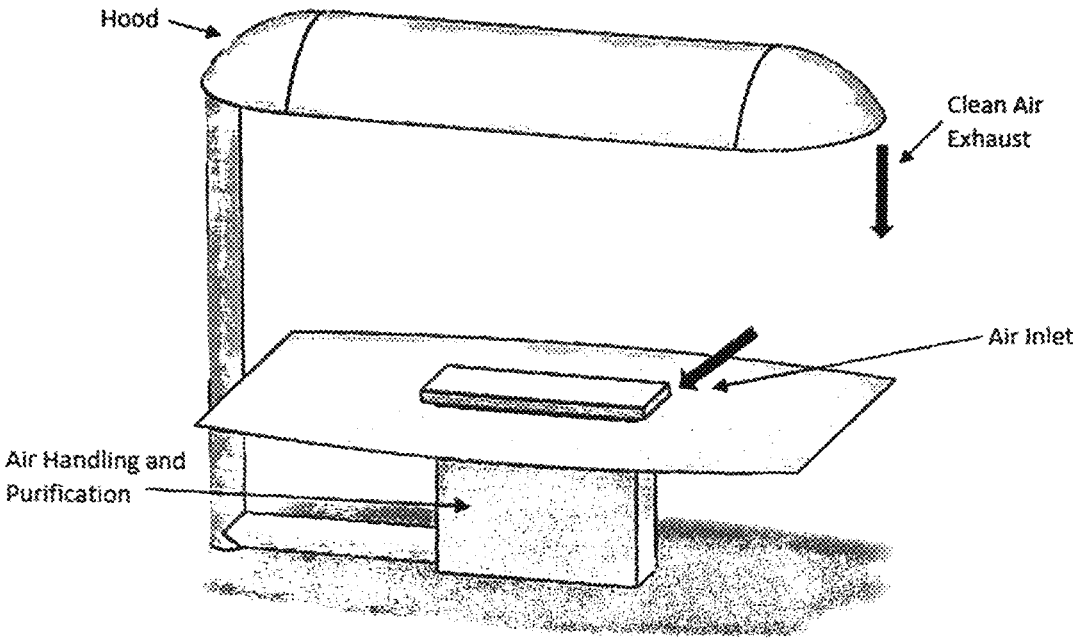
FIG. 4 is an isometric view of the test apparatus identifying major components.
Figure 5:
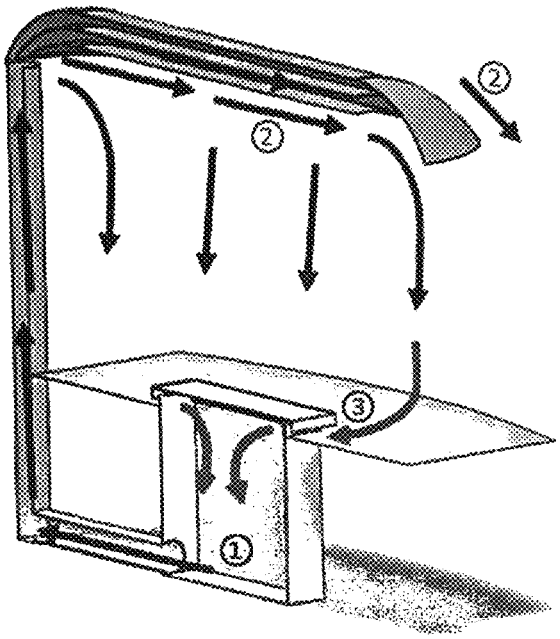
FIG. 5 is a cutaway of the isometric view detailing flow directions with arrows.

The inventors created a full scale flow model to test the apparatus. FIG. 4 provides a non-dimensional isometric view and FIG. 5 provides a section view of the test apparatus. One of the challenges was to form the air curtain at effective air velocities so that the air knife re-directs the droplets without the air currents being excessive at or over the occupants as this would create discomfort or annoyance. It was discovered that narrow slots with an angle away from the occupant and toward the pickup point worked best in a table setting. Discharge velocities out of the nozzles are in the range of 800 to 2500 feet per minute (FPM). The nozzles that are directed at or near persons quickly slow down to 50 to 250 fpm by the time the air curtain reaches the occupants due to the induction of more air. Velocities of 100 to 500 fpm are acceptable if and when directed away from occupants. The direct effect of suction at the intake locations are nearly negligible as only the air in close proximity can be influenced, whereas discharge air streams are effective for changing airflow direction and velocity of particles at greater distances. Although this invention can be applied by moving and capturing droplets in any direction, the preferred direction is downward. Doing so allows gravity to assist in moving larger droplets downward while the combination of air jets and pickup locations move droplets of smaller size (under 50 micron).

Figure 6:
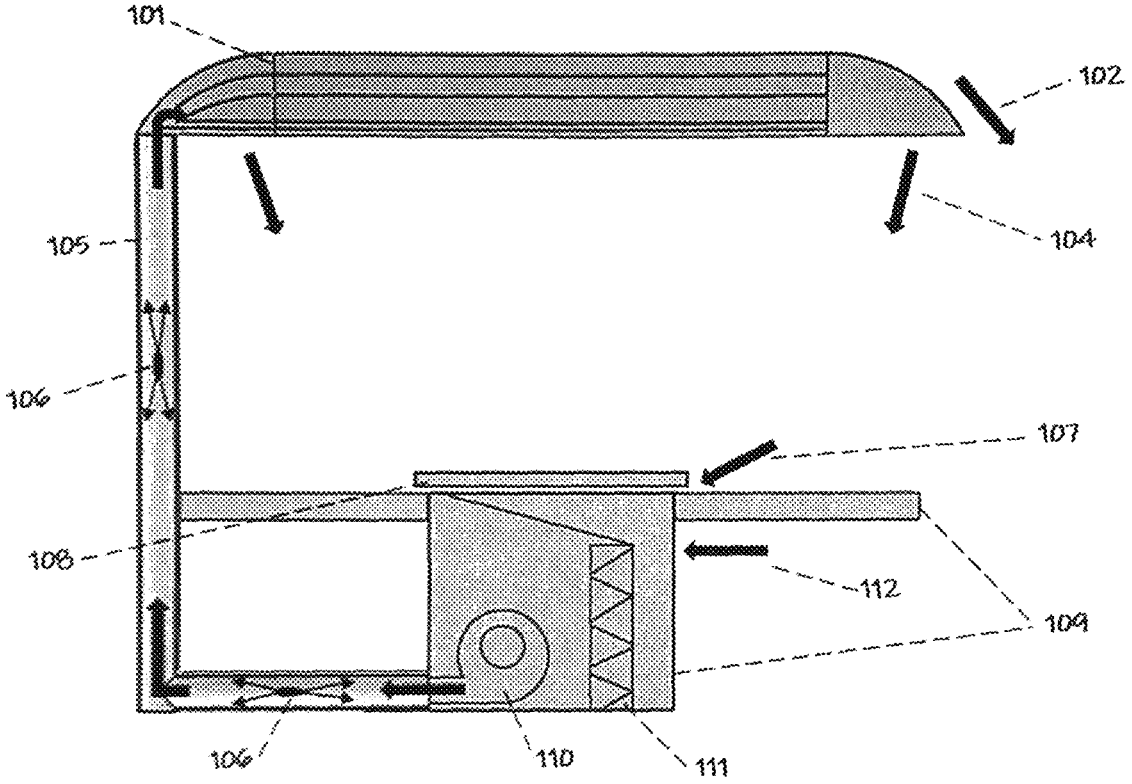
FIG. 6 is a diagram detailing the invention.

Through testing it was discovered that to effectively capture all exhaled gasses from multiple individuals a negative balance of the recycled air must be established. While the intake air volume is exactly the same as the discharge volume, an amount between 5% and 40%, and more ideally 25% to 35%, should be directed away from the occupants. This results in two major benefits: 1) the air directed away from the occupants is used to create a clean air envelope outside or surrounding the device and or occupants, thus protecting them from contamination from the surrounding, and 2) the redirection creates an imbalance in pressure resulting in negative air pressure at the center of the system that is used to capture all droplets and particles exhausted through breath. As seen in FIG. 6, item 102 represents the flow away from the occupants and item 104 represents the flow between and/or in front of the occupants.

One embodiment is detailed in FIG. 6 of the Drawings section to demonstrate the arrangement used for a table. Item 109 is the table top including the table base with item 107 being the air intake located in the center of the table. Item 108 is a porous cover over the intake to distribute the air inlet, reduce noise and eliminate any UV light or other processes from being in view of the occupants. The table support element (item 109) houses the draft fan (item 110) and the filter (item 111). Item 105 is a vertical tube that transports the recycled air from the base to the hood (item 101). Item 105 also houses the UV light or additional treatment systems (item 106) used to destroy pathogens.

Please note UV light, electrostatics and other air cleaning equipment can be housed in items 109, 105 or 101 as practical. As previously stated, clean air is discharged out of the hood (item 101) through a separate nozzle or nozzles. Nozzle or Nozzles indicated by item 102 direct air around the table providing an air curtain around the occupants while nozzle(s) indicated by item 104 direct air between the occupants toward the air pickup (item 107). It may be desirable to have air inlets below the table (item 112) in some configurations to treat the air discharged from item 102. It should be sufficient for anyone skilled in the science of air flow to understand the principles and operation of the table.

REFERENCES CITED

[1] World Health Organization. (2020 Mar. 29). Modes of transmission of virus causing COVID-19: implications for IPC precaution recommendations. World Health Organization. https://www.who.int/news-room/commentaries/detail/modes-of-transmission-of-virus-causing-covid-19-implications-for-ipc-precaution-recommendations

The invention claimed is:

1. A modular air curtain device for treating and recycling air in an occupant zone, the device comprising:

a table structure centrally located at a bottom of the occupant zone such that the occupant zone surrounds the table structure, wherein the table structure comprises a substantially horizontal, flat table surface, containing and forming a perimeter around an air intake, wherein the air intake is centrally located within the table surface;

a table support element which supports the table structure below the table surface, wherein the table support element houses a draft fan and at least one air treatment system, and wherein the draft fan is pneumatically connected upstream to the air intake, and wherein the draft fan is operative to induce a negative air pressure at the air intake, so as to draw into the air intake an intake air flow from the occupant zone, and wherein the draft fan is pneumatically connected downstream to the at least one air treatment system, and wherein the at least one air treatment system are operative to remove and/or destroy pathogens from the intake air flow;

an exhaust hood located above the occupant zone, wherein the exhaust hood is pneumatically connected upstream to the at least one air treatment system via a duct, and wherein the exhaust hood is pneumatically connected downstream to multiple exhaust nozzles, and wherein the exhaust nozzles comprises at least one curtain air nozzle and at least one occupant air nozzle, and wherein the at least one curtain air nozzle is/are configured to direct a positive pressure curtain air flow outwardly around a periphery of the occupant zone, so as to pneumatically isolate the occupant zone from an ambience, and wherein the at least one occupant air nozzle is/are configured to direct a positive pressure occupant air flow directly downward through the occupant zone and directly downward into the air intake, so as to entrain suspended aerosols and suspended pathogens in the occupant zone and carry them into the air intake, and wherein the duct houses at least one secondary air treatment system.

2. The device according to claim 1, wherein the curtain air flow is between 5% and 40% by volume of a total air flow of the exhaust nozzles.

3. The device according to claim 2, wherein the curtain air flow is between 25% and 35% by volume of the total air flow of the exhaust nozzles.

4. The device according to claim 2, wherein the exhaust nozzles have a discharge velocity between 800 and 2500 feet per minute.

5. The device according to claim 3, wherein the exhaust nozzles have a discharge velocity between 800 and 2500 feet per minute.

6. The device according to claim 4, when the at least one air treatment system and the at least one secondary air treatment system comprise air filters, electrostatics, and/or ultraviolet light.

7. The device according to claim 5, when the at least one air treatment system and the at least one secondary air treatment system comprise air filters, electrostatics, and/or ultraviolet light.

8. The device according to claim 6, wherein the air intake is covered by a porous cover which is operative to block noise and light from the at least one air treatment system.

9. The device according to claim 7, wherein the air intake is covered by a porous cover which is operative to block noise and light from the at least one air treatment system.

* * * * *